United States Patent [19]

Schleimer et al.

[11] Patent Number: 4,767,036

[45] Date of Patent: Aug. 30, 1988

[54] APPARATUS AND METHOD FOR EMPTYING METALLURGICAL VESSELS CONTAINING METAL AND SLAG

[75] Inventors: Francois Schleimer; Jean Goedert; Ferdinand Goedert; Romain Henrion, all of Esch/Alzette; Fernand Thill, Kockelscheuer; Henri Klein, Niedercorn; Jean-François Liesch, Luxembourg, all of Luxembourg

[73] Assignee: Arbed S.A., Luxembourg, Luxembourg

[21] Appl. No.: 505,293

[22] Filed: Jun. 17, 1983

[30] Foreign Application Priority Data

Jun. 18, 1982 [LU] Luxembourg ..... 84213

[51] Int. Cl.[4] ..... B22D 41/08

[52] U.S. Cl. ..... 222/590; 222/594; 222/603; 222/195

[58] Field of Search ..... 222/590, 591, 594, 603, 222/195; 164/335, 437; 75/60, 59

[56] References Cited

U.S. PATENT DOCUMENTS

| | | | |
|---|---|---|---|
| 3,060,015 | 10/1962 | Spolders et al. | 75/60 |
| 3,469,740 | 9/1969 | Crowe | 222/590 |
| 4,360,190 | 11/1982 | Ato | 222/603 |
| 4,373,705 | 2/1983 | Yamada | 222/590 |
| 4,378,106 | 3/1983 | Hirschberg et al. | 75/59 |

*Primary Examiner*—H. Grant Skaggs
*Assistant Examiner*—David H. Bollinger
*Attorney, Agent, or Firm*—Fishman, Dionne & Cantor

[57] ABSTRACT

An apparatus and method is presented for emptying metallurgical vessels, and in particular steelmaking converters containing metal and slag, whereby the slag is effectively separated from the metal during pouring. The apparatus includes at least on permeable refractory element located near the flow hole. An agitating gas is fed through the refractory element thereby creating a bubbling froth which effectively obstructs most of the slag from being carried along by the vortex which forms above the vertical flow hole.

15 Claims, 1 Drawing Sheet

APPARATUS AND METHOD FOR EMPTYING METALLURGICAL VESSELS CONTAINING METAL AND SLAG

BACKGROUND OF THE INVENTION

This invention relates to an apparatus and method for emptying metallurgical vessels. More particularly, this invention relates to apparatus and method for emptying steelmaking converters containing metal and slag whereby desired separation of slag and metal is effectuated.

When molten metal, particularly steel, is emptied from one vessel into a ladle or any other transport or treatment receiver, a certain amount of slag will generally pass through the tap hole or flow hole near the end of the metal flow. This may result in an undesirable rephosphorization of the steel. Moreover, due to the elevated activity of oxygen in the slag, the metallurgical processing of calmed and semi-calmed steels is made more difficult. Another problem caused by the slag is the risk of critical desulfurization of the steel.

Because of these serious problems, strenuous efforts have been made to avoid slag carryover when metallurgical vessels are emptied. These efforts have resulted in the development of various well known prior art devices including the stop valve, the slide valve and the heavy float. In the heavy float apparatus, a ceramic element floats above the opening of the tap or flow hole and has a cross-section which is larger than that of the flow opening. The ceramic float has a density between that of the metal and slag and functions by obstructing the flow hole after most of the metal has flowed out.

While these prior art devices have been effective in reducing the flow of slag into the ladle or other receiver, they have proved inadequate in diminishing the quantity of slag carried along by the turbulence or vortex which forms above the flow hole. It has been previously suggested that the vortex effect may be reduced by the injection of an agitating gas into the metallic bath through injection nozzles in the immediate vicinity of the flow hole. Unfortunately, the nozzles used to effect this injection are easily susceptible to plugging and therefore require relatively significant quantities of gas during both the pouring and processing phases. This large amount of gas produces the undesirable result of a pronounced cooling of the molten metal. Moreover, the nozzles which contact the molten slag and metal have very limited lifespans relative to the adjacent lining of the crucible. The somewhat disappointing results of the nozzle injection method is probably due to the fact that the gaseous bubbling issuing from the nozzles is not sufficiently distributed in the vortex and therefore does not sufficiently retain the slag.

SUMMARY OF THE INVENTION

The above-discussed and other related problems of the prior art are reduced or eliminated by the apparatus of the present invention whereby the quantity of slag carried along by the vortex which forms above the vertical tap or flow hole is greatly limited as compared to prior art devices.

In accordance with the present invention, at least one permeable refractory element unit is located in the vessel wall adjacent to the flow hole, and an apparatus or stirring gas is introduced through that permeable element into the molten metal adjacent the flow hole and in the general direction along and inclined relative to the axis of the flow hole into the area where the vortex would be formed. This element is comprised of at least one elongated segment, preferably having a rectangular cross-section, which has a distribution chamber on its cold side (i.e., the side exterior of the vessel) connected by a conduit to a source of an agitating or stirring agent. The agitating agent should be a nonreactive gas such as, but not limited to, argon, nitrogen or carbon dioxide. This agitating gas intersects the vortex area and acts to restrain or interfere with the vortex and restrain the slag normally carried along therein.

The device of the present invention creates an enhanced separation of the metal and slag, both in the course of, and toward the end of the emptying of the crucible. Another advantage of the present invention includes a savings in lime required in the crucible realized by a reduction in the loss of slag through the flow hole. Also, both reduced rephosphorization of the steel and a higher yield of ferroalloys introduced into the metal after pouring are realized.

BRIEF DESCRIPTION OF THE DRAWING

Referring now to the drawings.

DESCRIPTION OF THE PREFERRED EMBODIMENT

Figure 1:
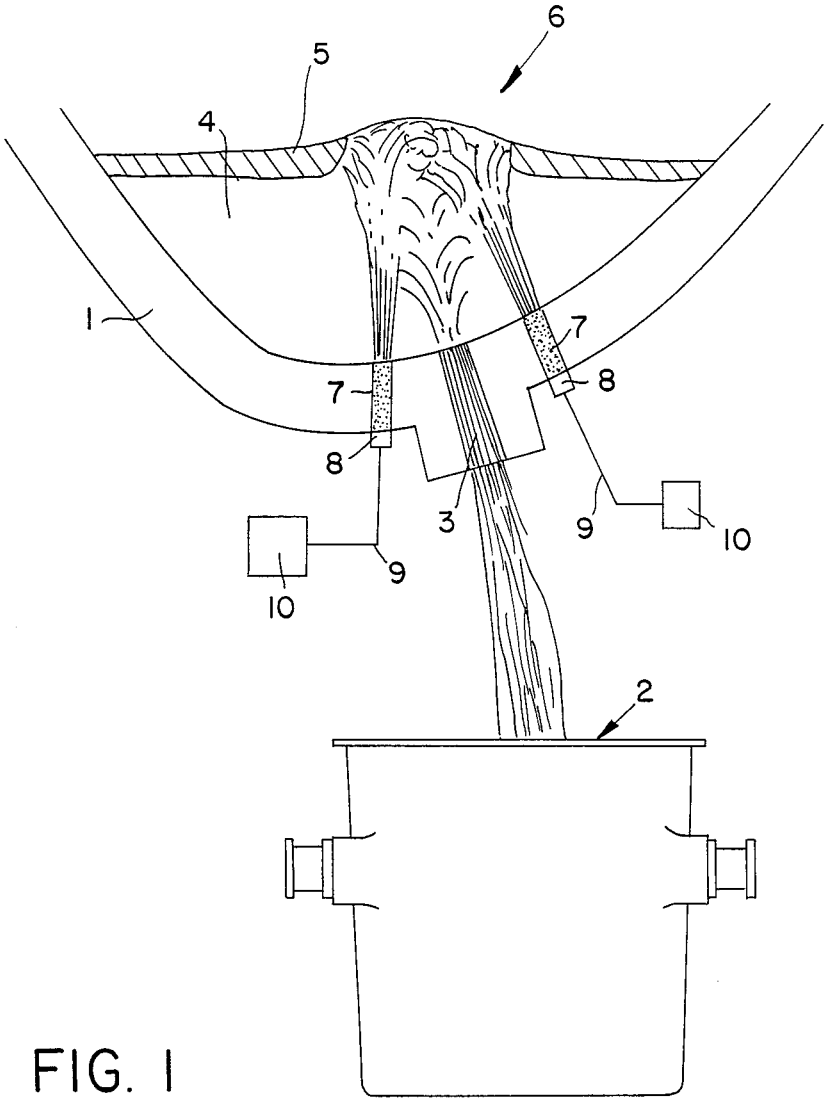
FIG. 1 is a cross sectional elevation view of the present invention in the pouring position.

Referring now to FIG. 1, the slag separating apparatus of the present invention is shown in a refining crucible 1 tilted to the pouring position above a ladle 2. In practical application, to avoid any premature flow of slag and metal during pouring, the flow hole 3 would have been previously obstructed by a wooden plug. After tilting, this plug is rapidly consumed by the molten metal and/or is pushed out of the flow hole 3, thus freeing the passage for the molten steel 4.

Two permeable refractory element units 7 permeable to an agitating agent are situated on each side of the flow hole 3. Although the location of these elements 7 is not critical, desired results have been obtained by positioning them about 0.5 meters from the axis of the flow hole. The permeable elements are arranged in a direction generally along and inclined toward the axis of the flow hole whereby the gas flow through the elements into the metal will intersect the vortex area. Permeable element units 7 should, preferably, be constructed and operated in accordance with the teachings of Luxembourg patent application Nos. 82,552, 82,553 and 82,554 (combined as U.S. application Ser. No. 277,218, filed June 25, 1981 now U.S. Pat. No. 4,395.026, all of which are assigned to the assignee hereof, and the entire contents of which are hereby incorporated herein by reference thereto. These permeable refractory element units 7 are each usually comprised of a large number of adjacent elongated refractory segments of a rectangular cross-section and surrounded by a metal casing.

On the cold side of the refractory element unit 7 (i.e., outside surface of the crucible 1) a metal distribution chamber 8 is welded to outer metal casing of the refractory element unit. A conduit or tubing 9 connects the distribution chamber 8 to a container 10 which holds the agitating or stirring agent. The agitating agent passes through the permeable element at the interface of the individual segments in the permeable elements 7 creating a well-distributed frothing of the agitating agent. The agitating agent is preferably a nonreactive gas such as, but not limited to, nitrogen, argon or carbon dioxide. Because of the intense and continuous bubbling caused by the rising froth of agitating gas, a circular region of turbulence 6 is created above the flow hole 3. This turbulent region 6 prevents the slag 5 from entering the vortex so that the steel 4 can flow through the hole 3 without slag 5 being carried along therewith. As shown in FIG. 1, the circular region 6 caused by the turbulent frothing gas is essentially freed of slag 5, thus effectuating the desirable separation of metal and slag so that the metal flows through flow hole 3 without slag.

Experimentation has shown that during processing, an agitating gas of, for example, nitrogen, flowing at 2–3 cubic meters/hour ensures the permeability of the permeable refractory element units 7. During the pouring operation, the flow should be increased to 5–10 cubic meters/hour in order to overcome the mixing effects of the vortex. This higher agitating gas flows generates projections (i.e., gas flow) which mix with the slag and are then carried with the gas toward the flow hole. It has been found that by adjusting the flow of agitating gas, an improved yield of ferro-manganese of from 2–5% can be obtained for semi-calmed steel. This improved yield equates to an average savings of 0.34 kg/ton of steel. Also, the present invention reduces rephosphorization. In pourings using the present invention, the percentage of pouring having a high rephosphorization, on the order of 0.025% P, was reduced by about 50%; whereas the percentage of those displaying a low rephosphorization, on the order of 0.002% P, was practically doubled (both as compared to prior practices).

Although the invention has been described in relation to a tilting crucible 1, it can equally as well be utilized with static metallurgical receivers having a flow hole in the bottom.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Emptying apparatus for a metallurgical vessel for metal and slag, the vessel having a flow hole, and the emptying apparatus including:

injection means for injecting an agitating agent into the vessel in the vicinity of the flow hole, said injection means being in the wall of the vessel in the vicinity adjacent to and exterior of the flow hole;

said injection means comprising;

at least one permeable refractory element unit;

said unit having at least one elongated refractory segment; said unit being positioned to direct an agitating agent flow generally along and at an angle inclined toward the axis of said flow hole to intersect the vortex above said flow hole;

a distribution chamber connected to the side of said refractory element unit on the exterior side of the vessel; and means for delivering an agitating agent from said distribution chamber through said permeable refractory element unit to effectuate a bubbling action.

2. The apparatus of claim 1 including:

two permeable refractory element units located on opposite sides of said flow hole exterior.

3. The apparatus of claim 2 wherein:

said refractory elements are spaced about 0.5 meters from said hole exterior.

4. The apparatus of claim 1 wherein:

said agitating agent is a nonreactive gas.

5. The apparatus of claim 4 wherein:

said nonreactive gas is selected from the group consisting of argon, nitrogen or carbon dioxide.

6. The apparatus of claim 1 wherein:

said permeable refractory element unit is comprised of a plurality of adjacent elongated refractory segments in a metal outer casing; and said distribution chamber is connected to said outer casing.

7. The apparatus of claim 1 including:

at least two permeable refractory element units located on opposite sides of said flow hole exterior.

8. The apparatus of claim 1 wherein:

said agitating agent is a nonreactive gas.

9. The apparatus of claim 8 wherein:

said nonreactive gas is selected from the group consisting of argon, nitrogen or carbon dioxide.

10. In the method of emptying molten metal from a metallurgical vessel through a flow hole, the vessel being equipped with a flow hole and at least one permeable refractory element unit in the wall of the vessel, said permeable refractory element being located adjacent to and exterior of the flow hole, the steps of:

delivering a first flow of inert gas through the permeable refractory element unit during processing of the molten metal; and delivering a second flow of inert gas through the permeable refractory element unit during pouring, said second flow being higher in volume than said first flow, at least said second flow being directed along and inclined with respect to the axis of said flow hole to intercept the vortex above the flow hole.

11. The method of claim 10 including;

introducing said first and second gas flows at at least two locations spaced apart about said flow hole exterior.

12. Wellblock apparatus for use at the opening of a bottom pour vessel for teeming molten metal said vessel containing a body of molten metal having a free surface, said apparatus comprising:

a body of low permeability refractory material for disposition in the bottom of said vessel and formed to contain an axial through-opening defining the vessel pour opening;

a refractory material of higher permeability than said low permeability material arranged in said body of low permeability material in concentrically spaced relation to said vessel pour opening and defining a passage through said low permeability material for the supply of gaseous fluid to the interior of said vessel;

means for supplying gaseous fluid to said passage; and means at the discharge end of said gaseous fluid flow passage effective to direct the flow of gaseous fluid injected into said vessel convergently in the direction of the free surface of the body of molten metal in said vessel.

13. Wellblock apparatus for use at the opening of a bottom pour vessel for teeming molten metal said vessel containing a body of molten metal having a free surface, said apparatus comprising:

a body of low permeability refractory material for disposition in the bottom of said vessel and formed to contain an axial through-opening defining the vessel pour opening;

a refractory material of higher permeability than said low permeability material arranged in said body of low permeability material in spaced relation to said vessel pour opening and defining a passage through said low permeability material for the supply of gaseous fluid to the interior of said vessel;

means for supplying gaseous fluid to said passage; and means at the discharge end of said gaseous fluid flow passage effective to direct the flow of gaseous fluid injected into said vessel convergently in the direction of the free surface of the body of molten metal in said vessel.

14. Apparatus for use at the opening of a vessel for teeming molten metal said vessel containing a body of molten metal having a free surface, said apparatus comprising:

a body of low permeability refractory material for disposition in said vessel and formed to contain an axial through-opening defining the vessel pour opening;

a refractory material of higher permeability than said low permeability material arranged in said body of low permeability material in concentrically spaced relation to said vessel pour opening and defining a passage through said low permeability material for the supply of gaseous fluid to the interior of said vessel;

means for supplying gaseous fluid to said passage; and means at the discharge end of said gaseous fluid flow passage effective to direct the flow of gaseous fluid injected into said vessel convergently in the direction of the free surface of the body of molten metal in said vessel.

15. A method of alleviating the occurrence of vortexing during the pouring of molten metal through the pour opening of a vessel comprising the steps of injecting a stream of gaseous fluid in the form of a dense bubble plume from at least one source adjacent the inlet of said pour opening and directing said dense bubble plume away from said pour opening in the direction of the free surface of molten metal in said vessel and inclined with respect to the axis of said pour opening to a degree sufficient to intersect the vortex above said pour opening.

* * * * *